US006526769B2

(12) United States Patent
Kim

(10) Patent No.: US 6,526,769 B2
(45) Date of Patent: Mar. 4, 2003

(54) REFRIGERATOR FOR KIMCHI

(75) Inventor: Cheol-hee Kim, Kwangju (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/795,351

(22) Filed: Mar. 1, 2001

(65) Prior Publication Data

US 2002/0002838 A1 Jan. 10, 2002

(30) Foreign Application Priority Data

Jul. 5, 2000 (KR) ..... 2000-38338

(51) Int. Cl.[7] ..... F25B 5/00
(52) U.S. Cl. ..... 62/199; 62/200
(58) Field of Search ..... 62/440, 186, 199, 62/200

(56) References Cited

U.S. PATENT DOCUMENTS

| | | | | | |
|---|---|---|---|---|---|
| 2,182,318 | A | * | 12/1939 | Newill | 62/200 |
| 3,359,751 | A | * | 12/1967 | Stevens | 62/186 |
| 3,390,540 | A | * | 7/1968 | Brush | 62/200 |
| 4,178,771 | A | * | 12/1979 | Karll | 62/200 |
| 5,031,414 | A | | 7/1991 | Walter et al. | |
| 5,052,190 | A | | 10/1991 | Gregory | |
| 5,424,210 | A | * | 6/1995 | Bae et al. | 435/289 |
| 5,465,591 | A | * | 11/1995 | Cur et al. | 62/199 |
| 5,498,430 | A | * | 3/1996 | Woo | 426/231 |
| 5,542,262 | A | * | 8/1996 | Park | 62/229 |
| 5,752,568 | A | * | 5/1998 | Lee | 165/206 |
| 6,063,420 | A | * | 5/2000 | Chun et al. | 426/231 |

FOREIGN PATENT DOCUMENTS

| | | |
|---|---|---|
| KR | 1997-0007186 | 2/1997 |
| KR | 1997-0007214 | 2/1997 |
| KR | 1997-0004337 | 3/1997 |
| KR | 0171745 | 10/1998 |
| KR | 1999-0074943 | 10/1999 |
| KR | 2000-0014024 | 3/2000 |
| KR | 2000-0059582 | 10/2000 |

* cited by examiner

*Primary Examiner*—William E. Tapolcal
*Assistant Examiner*—Mohammad M. Ali
(74) *Attorney, Agent, or Firm*—Robert E. Bushnell, Esq.

(57) ABSTRACT

A refrigerator is provided, which includes a main body, an inner casing accommodated in the main body and formed with a plurality of storage chambers arranged up and down, a compressor provided in a machine room and isolated from the storage chambers, and a condenser for condensing a refrigerant supplied from the compressor. The refrigerator includes a plurality of evaporators surrounding the inner casing to form a refrigerant flow path toward the lower portion of each storage chamber from the upper portion thereof, a refrigerant valve installed at a refrigerant tube extended from the condenser to an inlet of each evaporator, a suction tube extended from an outlet of each evaporator to the compressor, and a plurality of temperature sensors disposed in the upper portion of each storage chamber, for detecting the temperatures of the respective storage chambers.

12 Claims, 6 Drawing Sheets

REFRIGERATOR FOR KIMCHI

CLAIM OF PRIORITY

This application makes reference to, incorporates the same herein, and claims all benefits accruing under 35 U.S.C. §119 from my application entitled REFRIGERATOR FOR KIMCHI filed with the Korean Industrial Property Office on Jul. 5, 2000 and there duly assigned Serial No. 2000/38338.

BACKGROUND OF THE INVENTION

1. Field of the Invention

The present invention relates to a refrigerator, such as by way of example, for kimchi, and more particularly, to a refrigerator, such as for kimchi, having an improved temperature detection mechanism in a storage chamber.

2. Description of the Related Art

FIG. 1 is a perspective view of a refrigerator, such as for kimchi. FIG. 2 is a side sectional view of FIG. 1. As shown in FIGS. 1 and 2, the refrigerator, such as for kimchi, includes a main body 3 having front door openings and doors 5 installed in the front of the main body 3, for opening and closing the door openings. The main body 3 includes an outer casing 10 defining an external appearance and an inner casing 20 accommodated in the outer casing 10 with a foaming agent space and formed with storage chambers 21*a* and 21*b*.

The outer casing 10 has a substantially rectangular vessel shape. On the upper-front portion of the outer casing 10 is provided a manipulation panel 11 for enabling a user to select a ripening time and a temperature condition of foods, such as kimchi, contained in the storage chamber and to control a ripening mode or a cool storage mode. In the lower-rear portion of the outer casing 10 is formed a machine room 13 isolated from the storage chambers of the inner casing 20.

The pair of upper storage chamber 21*a* and lower storage chamber 21*b* are formed on the upper portion and the lower portion of the outer casing 10, respectively. Storage containers 25 for containing foods, such as kimchi, are accommodated in the respective storage chambers 21*a* and 21*b*.

FIG. 3 is a rear perspective view of a conventional kimchi refrigerator. FIG. 4 is a diagram showing a freezing cycle of FIG. 3. As shown in FIGS. 3 and 4, a single compressor 131 for compressing a refrigerant and a condenser 141 for condensing the refrigerant supplied from the compressor 131 are installed in the machine room 13 of the conventional kimchi refrigerator 101.

First and second heaters 161*a* and 161*b* which are operated by a supply of power, for maintaining the internal temperature of the respective storage chambers 21*a* and 21*b* at predetermined temperatures, and first and second evaporators 151*a* and 151*b* for cooling the storage chambers 21*a* and 21*b* using the refrigerant supplied from the condenser 141, are installed in the foaming agent space between the outer casing 10 and the inner casing 20. The first and second evaporators 151*a* and 151*b* and the first and second heaters 161*a* and 161*b* are disposed in such a manner that they substantially contact the side walls and the rear wall of the storage chambers 21*a* and 21*b*.

The first and second evaporators 151*a* and 151*b* constitute zigzag refrigerant flow paths toward the upper portions from the lower portions of the storage chambers 21*a* and 21*b*, respectively. First and second refrigerant valves 145*a* and 145*b* for controlling supply of the refrigerant are respectively installed on branch refrigerant tubes 144*a* and 144*b* extended toward respective lower inlets 183*a* and 183*b* of the first and second evaporators 151*a* and 151*b* from the condenser 141. Refrigerant discharge tubes 153*a* and 153*b* extended toward the compressor 131 from upper outlets 181*a* and 181*b* of the respective first and second evaporators 151*a* and 151*b* are connected to a refrigerant suction tube 143 connected to a suction port (not shown) of the compressor 131.

First and second temperature sensors 171*a* and 171*b* for sensing the temperatures of storage chambers 21*a* and 21*b* are installed in the upper portions of the respective upper and lower storage chambers 21*a* and 21*b* in such a manner that the first and second temperature sensors 171*a* and 171*b* are adjacent to the upper portions of the first and second evaporators 151*a* and 151*b*, respectively. As described above, the first and second temperature sensors 171*a* and 171*b* are installed in the upper portions of the respective storage chambers 21*a* and 21*b* to sense the temperatures of each storage chambers 21*a* and 21*b*. This is for preventing the respective temperature sensors 171*a* and 171*b* from sensing temperatures differing from actual temperatures of the storage chambers 21*a* and 21*b*. In the case that the temperature sensors 171*a* and 171*b* are located on the lower portions of the respective storage chambers 21*a* and 21*b*, the temperatures detected by the sensors 171*a* and 171*b* may differ from the actual temperatures of the storage chambers 21*a* and 21*b* since the remaining refrigerant exists in the lower portions of the respective evaporators 151*a* and 151*b*.

A controller (not shown) for controlling the operations of the components including the compressor 131, the first and second refrigerant valves 145*a* and 145*b* is provided in a predetermined portion of the main body 3 on the basis of the running mode selected through the manipulation panel 11 and the temperatures sensed by the respective temperature sensors 171*a* and 171*b*.

In the above-described kimchi refrigerator, when power is supplied to the kimchi refrigerator and a running condition, e. g., the cool storage mode is input through the manipulation panel 11, the compressor 131 starts to operate and compresses the refrigerant. The refrigerant compressed in the compressor 131 is supplied to the condenser 141 and via the refrigerant tubes 144*a* and 144*b* the refrigerant condensed in the condenser 141 is supplied to the first and second evaporators 151*a* and 151*b*, to thereby cool the respective storage chambers 21*a* and 21*b*. Here, the refrigerant moves to the upper portions of the respective storage chambers from the lower portions thereof along the refrigerant flow paths of the respective evaporators 151*a* and 151*b*.

The refrigerant that has been supplied to the first and second evaporators 151*a* and 151*b* and has cooled the respective storage chambers 21*a* and 21*b* is discharged along the refrigerant discharge tubes 153*a* and 153*b* connected to the upper outlets 181*a* and 181*b* of the respective evaporators 151*a* and 151*b*, and then returns to the compressor 131 via the suction tube 143 of the compressor 131.

The controller (not shown) controls the operations of the first and second refrigerant valves 145*a* and 145*b* appropriately on the basis of the temperature values of the upper and lower storage chambers 21*a* and 21*b* sensed by the respective first and second temperature sensors 171*a* and 171*b*, to thereby independently control the temperatures of the upper and lower storage chambers 21*a* and 21*b*.

The first and second temperature sensors 171*a* and 171*b* for sensing the temperatures of the respective storage chambers 21*a* and 21*b* are installed adjacent to the respective evaporators 151*a* and 151*b* of the upper portions of the storage chambers 21*a* and 21*b* in the conventional kimchi refrigerator. Accordingly, in the case that one of the first and second refrigerant valves 145*a* and 145*b* is opened and thus only one of the storage chambers 21*a* and 21*b* is cooled, for example, in the case that the first refrigerant valve 145*a* is opened and the second refrigerant valve 145*b* is closed, the refrigerant moves into the first evaporator 151*a*, to thus cool the upper storage chamber 21*a*, and the refrigerant is not supplied to the second evaporator 151*b*. Then, the refrigerant remaining in the lower portion of the second evaporator 151*b* moves to the upper portion thereof by a suction force of the compressor 131, to then return into the compressor 131 together with the refrigerant of the first evaporator 151*a*.

In this case, the temperature of the upper portion of the lower storage chamber 21*b* is varied, and thus the actual temperature of the lower storage chamber 21*b* becomes different from the temperature detected by the second temperature sensor 171*b* installed in the upper portion of the lower storage chamber 21*b* adjacent to the upper outlet 181*b* of the second evaporator 151*b*.

As a result, the second temperature sensor 171*b* cannot detect the actual inner temperature of the lower storage chamber accurately, and the controller cannot control the temperatures of the respective upper and lower storage chambers effectively.

SUMMARY OF THE INVENTION

Accordingly, the present invention has been made keeping in mind the above problem, and it is an object of the present invention to provide a refrigerator, such as for kimchi, for detecting an actual inner temperature of each storage chamber accurately and performing a temperature control effectively.

This and other objects of the present invention may be accomplished by a provision of a refrigerator, such as for kimchi, including a main body, an inner casing accommodated in the main body and formed with a plurality of storage chambers arranged up and down, a compressor provided in a machine room and isolated from the storage chambers, and a condenser for condensing a refrigerant supplied from the compressor, the refrigerator including: a plurality of evaporators surrounding the inner casing to form a refrigerant flow path toward the lower portion of each storage chamber from the upper portion thereof; a refrigerant valve respectively installed at a refrigerant tube extended from the condenser to a corresponding inlet of each evaporator; a suction tube extended from an outlet of each evaporator to the compressor; and a plurality of temperature sensors respectively disposed in the upper portion of each storage chamber, for detecting a corresponding temperature of a corresponding respective storage chamber.

Preferably, the storage chamber includes a pair of upper and lower storage chambers.

It is effective that each evaporator has a zigzag refrigerant flow path.

It is preferable that the refrigerant tube is extended from the inlet of each evaporator to the upper portion of each storage chamber via the refrigerant valve.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

A preferred embodiment of the present invention will be described with reference to the accompanying drawings.

Figure 5:
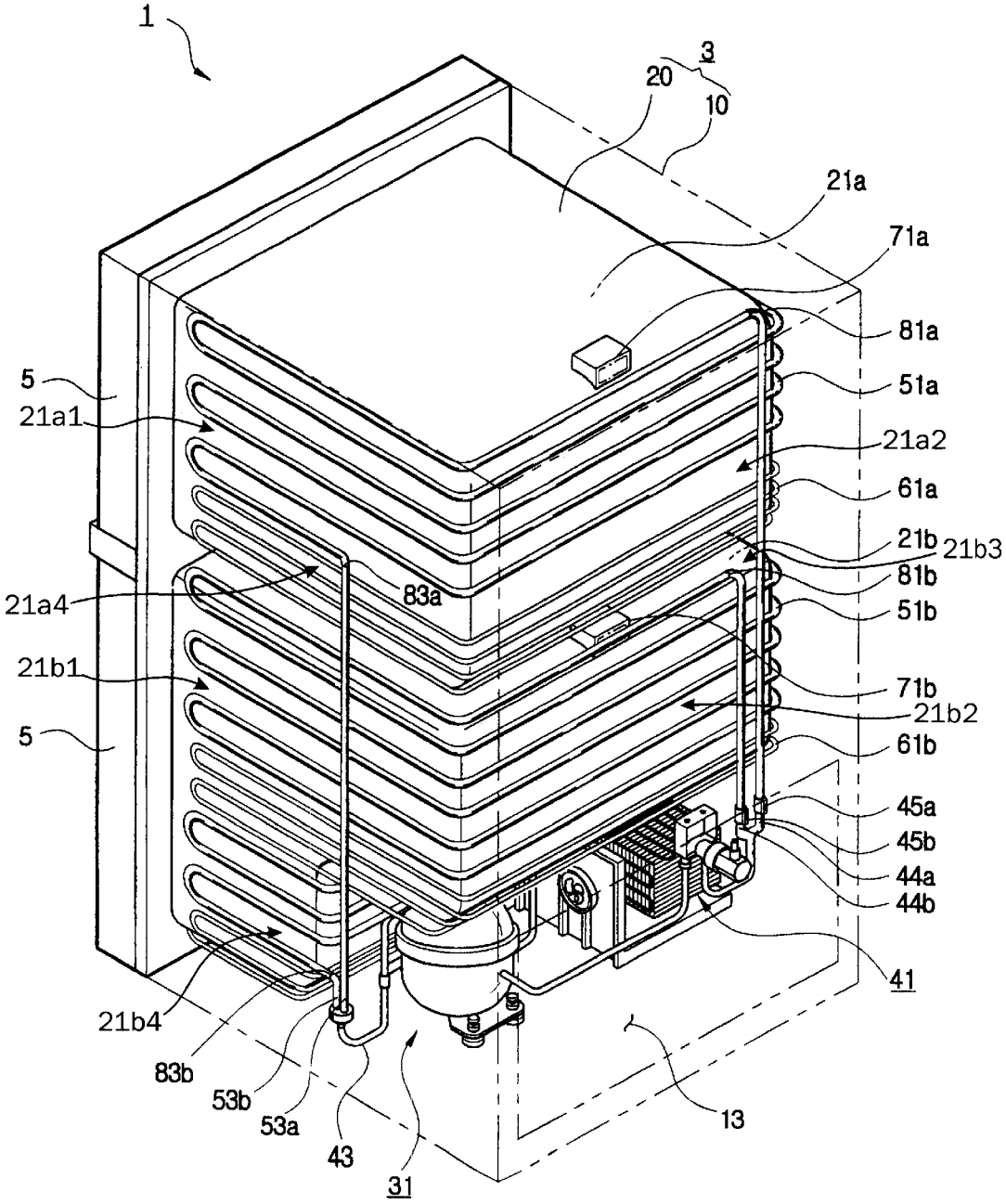
FIG. 5 is a rear perspective view of a refrigerator, such as for kimchi, according to the present invention.
Figure 6:
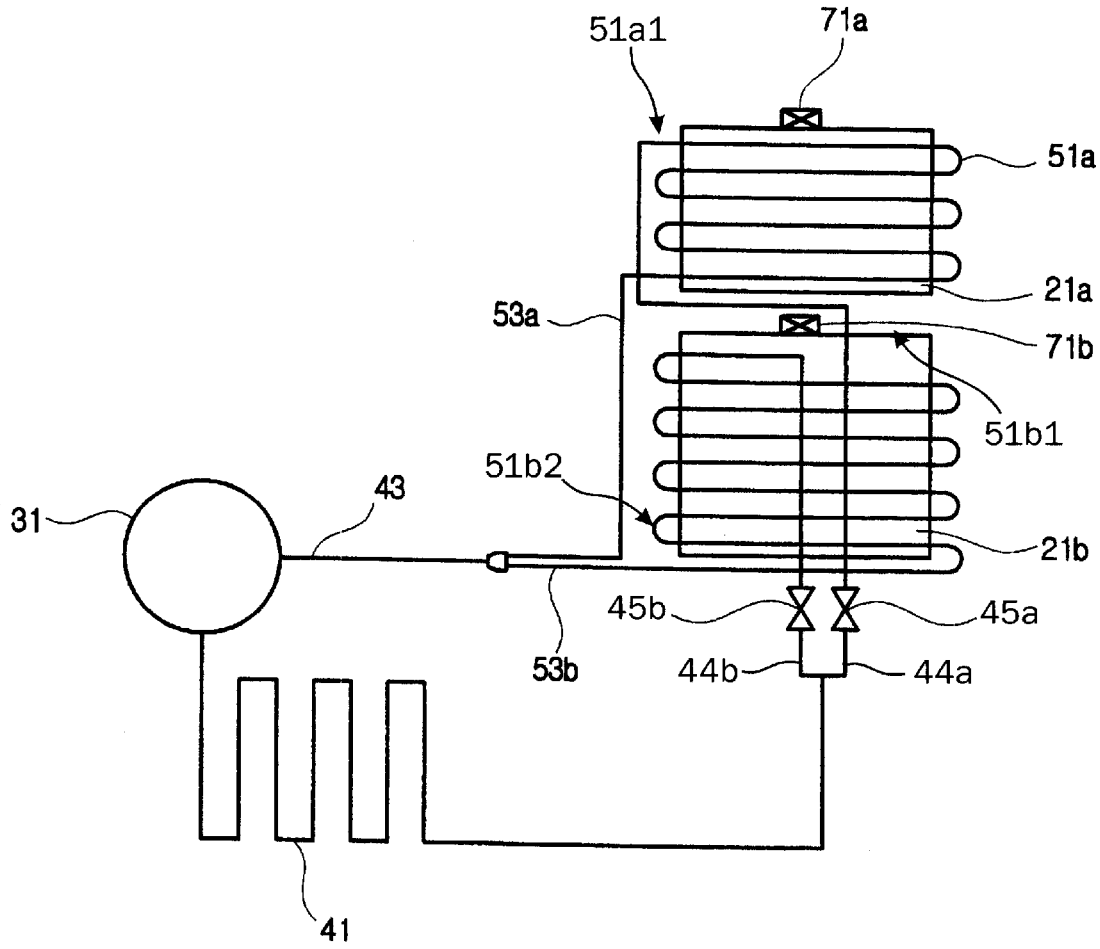
FIG. 6 shows a cooling cycle of FIG. 5.

As shown in FIGS. 5 and 6, a single compressor 31 for compressing a refrigerant and a condenser 41 for condensing the refrigerant supplied from the compressor 31 are installed in a machine room 13 of a refrigerator 1, such as for kimchi.

Figure 2:
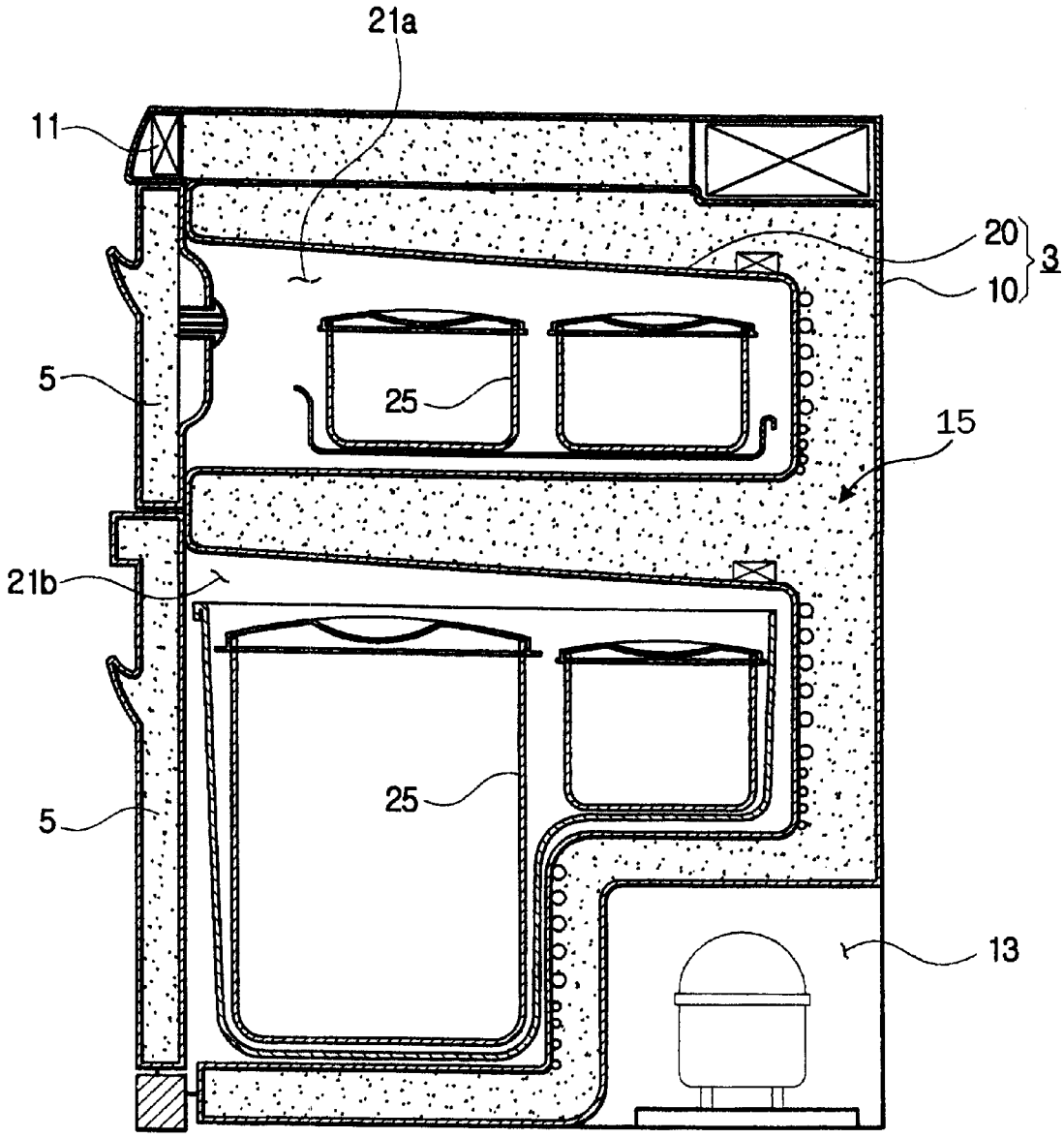
FIG. 2 is a side sectional view of FIG. 1.
Figure 3:
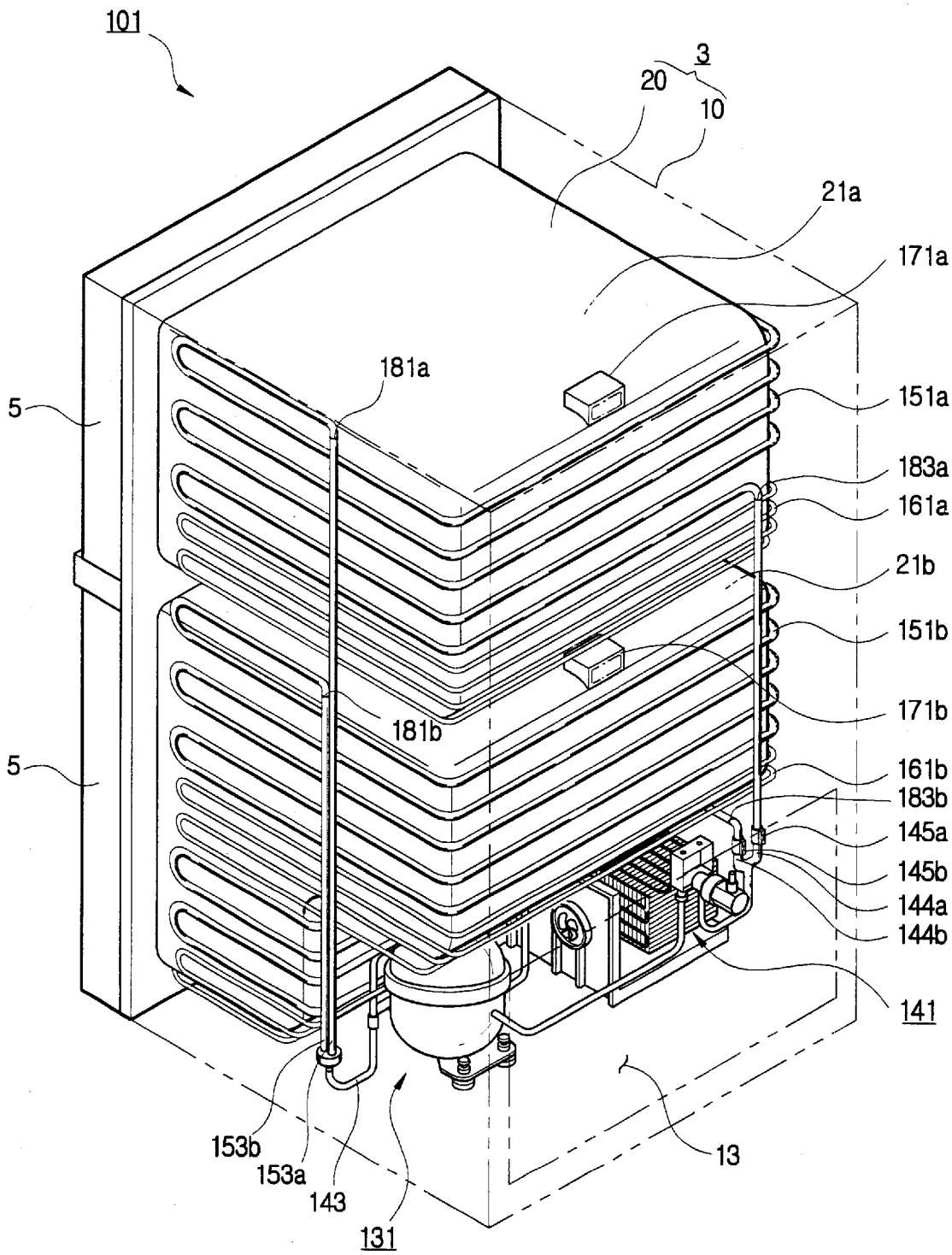
FIG. 3 (PRIOR ART)
FIG. 3 is a rear perspective view showing a conventional kimchi refrigerator.
Figure 4:
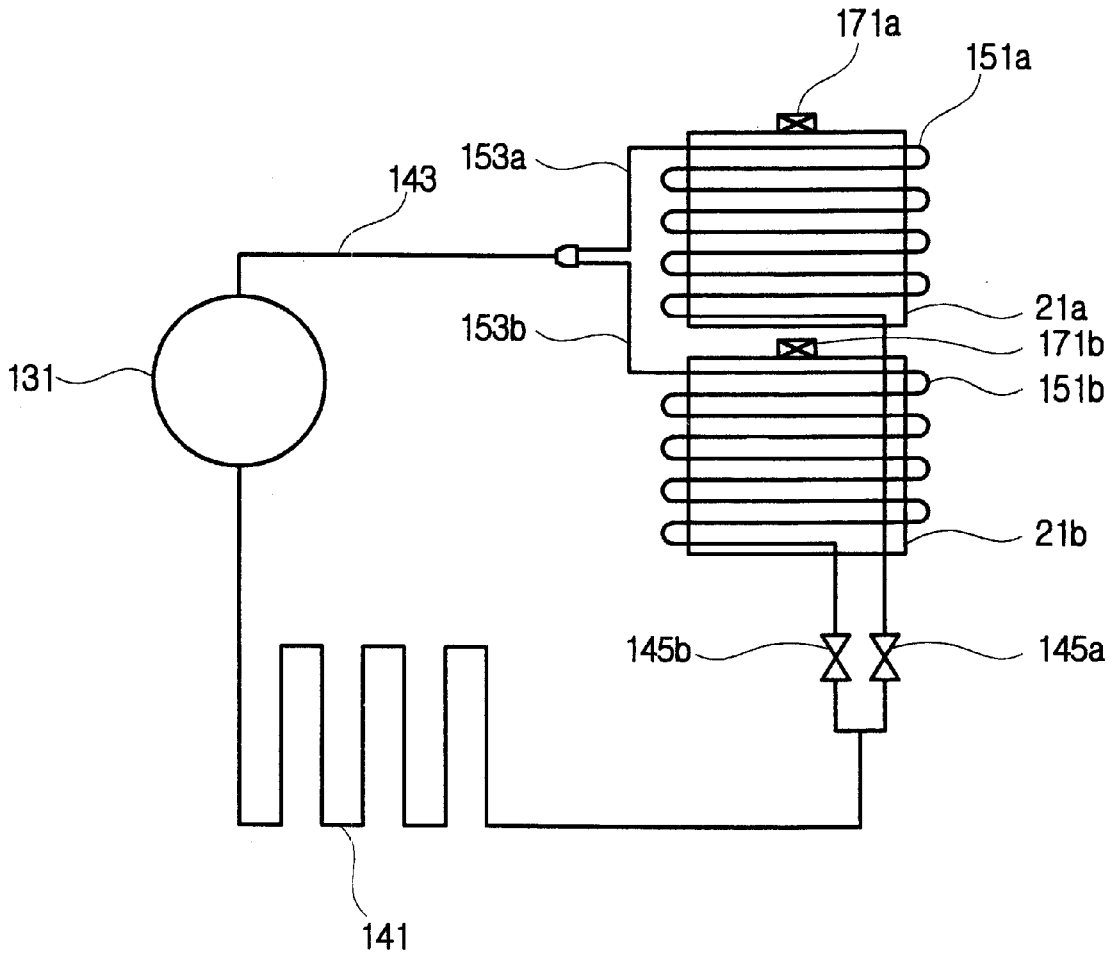
FIG. 4 (PRIOR ART)
FIG. 4 shows a cooling cycle of FIG. 3.

In a foaming agent space between an outer casing 10 and an inner casing 20, such as foaming agent space 15 of FIG. 2, are installed first and second heaters 61*a* and 61*b* operated by a power supply, for maintaining inner temperatures of storage chambers 21*a* and 21*b* at predetermined temperatures, and first and second evaporators 51*a* and 51*b* for cooling the storage chambers 21*a* and 21*b* using the refrigerant supplied from the condenser 41. The first and second evaporators 51*a* and 51*b* and the first and second heaters 61*a* and 61*b* are disposed substantially in respective contact with the side walls 21*a*1, 21*b*1 and the rear wall 21*a*2, 21*b*2 of the storage chambers 21*a* and 21*b*.

The first and second evaporators 51*a* and 51*b* form zigzag refrigerant flow paths from upper inlets 81*a* and 81*b* disposed in the respective upper portion 21*a*3, 21*b*3 of each storage chamber 21*a* or 21*b* to the respective lower portion 21*a*4, 21*b*4 thereof. First and second refrigerant valves 45*a* and 45*b* for controlling supply and cut-off of the refrigerant are installed along branch refrigerant tubes 44*a* and 44*b* extended toward the upper portions 51*a*1, 51*b*1 of the respective first and second evaporators 51*a* and 51*b* from the condenser 41. Refrigerant discharging tubes 53*a* and 53*b* extended toward the compressor 31 from the lower outlets 83*a* and 83*b* of the respective first and second evaporators 51*a* and 51*b* are connected to a refrigerant suction tube 43 connected to a suction port (not shown) of the compressor 31.

First and second temperature sensors 71*a* and 71*b* for respectively sensing the temperatures of the storage chambers 21*a* and 21*b* are installed in the upper portions 21*a*3, 21*b*3 of the respective upper and lower storage chambers 21*a* and 21*b* in such a manner that the first and second temperature sensors 71*a* and 71*b* are adjacent to the upper portions 51*a*1, 51*b*1 of the first and second evaporators 51*a* and 51*b*, respectively.

Figure 1:
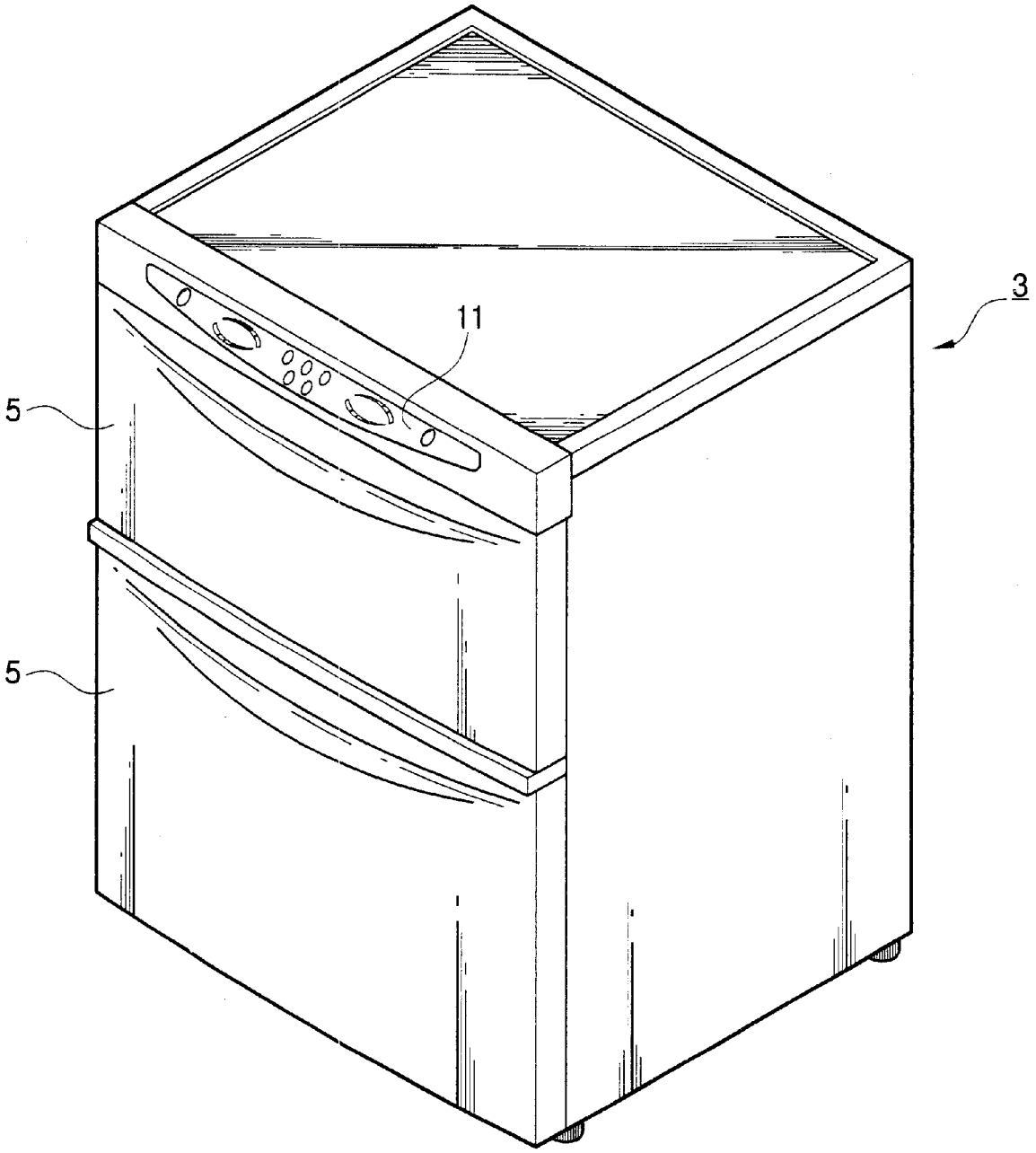
FIG. 1 is a perspective view of a refrigerator, such as for kimchi.

A controller (not shown) for controlling the operations of the components including the compressor 31, and the first and second refrigerant valves 45*a* and 45*b* is provided in a predetermined portion of the main body 3 on the basis of the running mode selected through a manipulation panel 11 (see FIG. 1) and the temperatures sensed by the respective temperature sensors 71*a* and 71*b*.

In the above-described refrigerator 1, such as for kimchi, when power is supplied to the refrigerator 1 and a running condition, e. g., a cool storage mode is input through the manipulation panel 11, the compressor 31 starts to operate and compresses the refrigerant. The refrigerant compressed in the compressor 31 is supplied to the condenser 41 via the refrigerant tubes 44*a* and 44*b* and the refrigerant condensed in the condenser 41 is supplied to the first and second evaporators 51*a* and 51*b*, to thereby cool the respective storage chambers 21*a* and 21*b*. Here, the refrigerant moves to the lower portions 21*a*4, 21*b*4 of the respective storage chambers 21*a* and 21*b* from the upper portions 21*a*3, 21*b* 3 thereof along the refrigerant flow paths of the respective evaporators 51*a* and 51*b*.

The refrigerant that has been supplied to the first and second evaporators 51*a* and 51*b* and has cooled the respective storage chambers 21*a* and 21*b* is discharged along the refrigerant discharge tubes 53*a* and 53*b* connected to the lower outlets 83*a* and 83*b* of the respective evaporators 51*a* and 51*b*, and then returns to the compressor 31 via the refrigerant suction tube 43 of the compressor 31.

The controller (not shown) controls the opening and closing operations of the first and second refrigerant valves 45*a* and 45*b* appropriately on the basis of the temperature values of the upper and lower storage chambers 21*a* and 21*b* sensed by the respective first and second temperature sensors 71*a* and 71*b*, to thereby independently control the temperatures of the upper and lower storage chambers 21*a* and 21*b*. The control process will be described in more detail as follows, for the upper storage chamber 21*a* and the lower storage chamber 21*b*, in sequence, for convenience of explanation.

Firstly, if the temperature of the upper storage chamber 21*a* detected by the first temperature sensor 71*a* is not lower than a first predetermined temperature, and the temperature of the lower storage chamber 21*b* detected by the second temperature sensor 71*b* is not higher than a second predetermined temperature, the controller (not shown) opens the first refrigerant valve 45*a* and closes the second refrigerant valve 45*b*, to thereby supply the refrigerant from the condenser 41 to only the first evaporator 51*a* to thus cool only the upper storage chamber 21*a*. The first predetermined temperature may be equal to or different from the second predetermined temperature, as necessary.

Then, if the temperature of the upper storage chamber 21*a* detected by the first temperature sensor 71*a* is not lower than the first predetermined temperature, and the temperature of the lower storage chamber 21*b* detected by the second temperature sensor 71*b* is not lower than the second predetermined temperature, the controller (not shown) opens the first refrigerant valve 45*a* and the second refrigerant valve 45*b*, to thereby supply the refrigerant from the condenser 41 to the first and second evaporators 51*a* and 51*b* to thus cool both the upper and lower storage chambers 21*a* and 21*b* simultaneously.

Also, if the temperature of the upper storage chamber 21*a* detected by the first temperature sensor 71*a* is not higher than the first predetermined temperature, and the temperature of the lower storage chamber 21*b* detected by the second temperature sensor 71*b* is not lower than the second predetermined temperature, the controller (not shown) closes the first refrigerant valve 45*a* and opens the second refrigerant valve 45*b*, to thereby supply the refrigerant from the condenser 41 to only the second evaporator 51*b* to thus cool only the lower storage chamber 21*b*.

As described above, the first and second evaporators 51*a* and 51*b* have the zigzag refrigerant flow paths from the upper portion 21*a*3, 21*b*3 of each storage chamber 21*a* or 21*b* to the lower portion 21*a*4, 21*b* 4 thereof and the first and second temperature sensors 71*a* and 71*b* for detecting the temperatures of the respective storage chambers 21*a* and 21*b* are installed in the upper portions 21*a*3, 21*b*3 of the respective storage chambers 21*a* and 21*b* adjacent to the upper inlets 81*a* and 81*b* of the respective evaporators 51*a* and 51*b*. Accordingly, even in the case that only one of the upper and lower storage chambers 21*a* and 21*b* is cooled, for example, in the case that the first refrigerant valve 45*a* is opened and the second refrigerant valve 45*b* is closed, to thereby cool only the upper storage chamber 21*a*, the refrigerant remaining in the lower portion 51*b*2 of the second evaporator 51*b* directly returns to the compressor 31, together with the refrigerant in the first evaporator 51*a*.

As a result, each temperature sensor can detect the actual temperature value of each storage 8 chamber accurately, and the controller can control the temperature of each storage chamber according to the actual temperature value of each storage chamber detected by each temperature sensor effectively.

As described above, the present invention provides a refrigerator, such as for kimchi, for detecting the actual temperature value of each storage chamber and controlling the temperature effectively.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A refrigerator, the refrigerator including a main body, an inner casing accommodated in the main body and including a plurality of storage chambers, a compressor provided in a machine room of the refrigerator and isolated from the plurality of storage chambers, and a condenser for condensing a refrigerant supplied from the compressor, the refrigerator comprising:

a plurality of evaporators surrounding the inner casing to respectively form a corresponding refrigerant flow path toward a lower portion of each storage chamber from an upper portion of each storage chamber of the plurality of storage chambers;

a plurality of refrigerant valves installed at a refrigerant tube that extends from the condenser to respective upper inlets of each evaporator of the plurality of evaporators;

a suction tube that extends from an outlet of each evaporator of the plurality of evaporators to an inlet of the compressor; and a plurality of temperature sensors respectively disposed in the upper portion of each storage chamber of the plurality of storage chambers and adjacent to an upper portion of each evaporator directly connected to the upper inlet of each evaporator of the plurality of evaporators, for detecting a corresponding temperature of each of the respective storage chambers of the plurality of storage chambers to control said refrigerant valves.

2. The refrigerator of claim 1, further comprised of the plurality of storage chambers including a pair of an upper storage chamber and a lower storage chamber.

3. The refrigerator of claim 1, further comprised of each evaporator of the plurality of evaporators including a zigzag refrigerant flow path.

4. The refrigerator of claim 1, further comprised of said refrigerator being a refrigerator for kimchi.

5. A refrigerator, comprising:

a main body;

a plurality of storage chambers located within the main body;

a compressor located within the main body for compressing a refrigerant;

a condenser located within the main body for condensing the refrigerant from the compressor;

a plurality of evaporators respectively surrounding the plurality of storage chambers to respectively form a corresponding refrigerant flow path for the refrigerant toward a lower portion of each storage chamber from an upper portion of each storage chamber of the plurality of storage chambers;

plural refrigerant valves installed at a refrigerant tube that extends from the condenser to an respective upper inlets of each evaporator of the plurality of evaporators;

a suction tube that extends from an outlet of each evaporator of the plurality of evaporators to an inlet of the compressor; and a plurality of temperature sensors respectively disposed in the upper portion of each storage chamber of the plurality of storage chambers and adjacent to an upper portion of each evaporator directly connected to the upper inlet of each evaporator of the plurality of evaporators, for detecting a corresponding temperature of each of the respective storage chambers of the plurality of storage chambers to control said refrigerant valves.

6. The refrigerator of claim 5, further comprised of the plurality of storage chambers including a pair of an upper storage chamber and a lower storage chamber.

7. The refrigerator of claim 5, further comprised of each evaporator of the plurality of evaporators including a zigzag refrigerant flow path.

8. The refrigerator of claim 5, further comprised of said refrigerator being a refrigerator for kimchi.

9. A method for cooling in a refrigerator, comprising the steps of:

providing a plurality of evaporators in surrounding relation to a plurality of storage chambers in a refrigerator;

forming a corresponding refrigerant flow path for a refrigerant for respectively cooling through each of the plurality of evaporators in a direction from an upper portion of a corresponding storage chamber of the plurality of storage chambers to a lower portion of the corresponding storage chamber of the plurality of storage chambers;

measuring a respective temperature of each storage chamber by a corresponding temperature sensor respectively disposed in the upper portion of each storage chamber; and controlling corresponding ones of a plurality of refrigerant valves disposed in said refrigerant flow path and at respective inlets to said plurality of evaporators in response to the measured temperatures of said storage chambers.

10. The method of claim 9, further comprised of forming the refrigerant flow path to include a zigzag configuration.

11. The method of claim 10, further comprised of said refrigerator being a refrigerator for kimchi.

12. The method of claim 9, further comprised of said refrigerator being a refrigerator for kimchi.

* * * * *